US008683908B1

(12) United States Patent
Lewis

(10) Patent No.: US 8,683,908 B1
(45) Date of Patent: Apr. 1, 2014

(54) PERSONAL ARMOR ASSEMBLY

(71) Applicant: Montree Lewis, Rocky Mount, NC (US)

(72) Inventor: Montree Lewis, Rocky Mount, NC (US)

( * ) Notice: Subject to any disclaimer, the term of this patent is extended or adjusted under 35 U.S.C. 154(b) by 0 days.

(21) Appl. No.: 13/743,481

(22) Filed: Jan. 17, 2013

(51) Int. Cl.
*F41H 5/12* (2006.01)

(52) U.S. Cl.
USPC ..... 89/36.05; 2/2.5

(58) Field of Classification Search
USPC ..... 89/36.05; 2/2.5; 224/637; 602/20, 23
See application file for complete search history.

(56) References Cited

U.S. PATENT DOCUMENTS

| | | | | |
|---|---|---|---|---|
| D344,589 | S | 2/1994 | Kilbey | |
| 6,892,392 | B2 * | 5/2005 | Crye et al. | 2/2.5 |
| 7,393,335 | B2 | 7/2008 | Carvey et al. | |
| 7,445,138 | B2 | 11/2008 | Chu | |
| 7,947,004 | B2 | 5/2011 | Kazerooni et al. | |
| 7,979,917 | B2 * | 7/2011 | Osborne | 2/2.5 |
| 2008/0009771 | A1 | 1/2008 | Perry et al. | |
| 2008/0154165 | A1 | 6/2008 | Ashihara et al. | |
| 2008/0298080 | A1 | 12/2008 | Wu et al. | |
| 2009/0151036 | A1 * | 6/2009 | Joseph | 2/2.5 |
| 2011/0040216 | A1 | 2/2011 | Herr et al. | |
| 2012/0132066 | A1 * | 5/2012 | Seuk | 89/36.05 |

* cited by examiner

*Primary Examiner* — J. Woodrow Eldred

(57) ABSTRACT

A personal armor assembly protects a person from being harmed from behind. The assembly includes a plurality of armor plates. Each armor plate is curved wherein each armor plate is configured to cover an associated dorsal section of a person. A body member is configured to be worn by the person. Each armor plate is coupled to the body member wherein the body member extends between the armor plates. The body member has a plurality of forwardly extending portions forming a plurality of loops wherein the body member is configured to extend around a body of the person. The armor plates are supported against the dorsal side of the person. A plurality of biasing members is coupled to and extends between adjacently positioned armor plates. The biasing members urge the armor plates into an upright position wherein the armor plates provide support to the person.

16 Claims, 5 Drawing Sheets

PERSONAL ARMOR ASSEMBLY

BACKGROUND OF THE DISCLOSURE

Field of the Disclosure

The disclosure relates to personal armor devices and more particularly pertains to a new personal armor device for protecting a person from being harmed from behind.

SUMMARY OF THE DISCLOSURE

An embodiment of the disclosure meets the needs presented above by generally comprising a plurality of armor plates. Each armor plate is curved wherein each armor plate is configured to cover an associated dorsal section of a person. A body member is configured to be worn by the person. Each armor plate is coupled to the body member wherein the body member extends between the armor plates. The body member has a plurality of forwardly extending portions forming a plurality of loops wherein the body member is configured to extend around a body of the person. The armor plates are supported against the dorsal side of the person. A plurality of biasing members is coupled to and extends between adjacently positioned armor plates. The biasing members urge the armor plates into an upright position wherein the armor plates provide support to the person.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
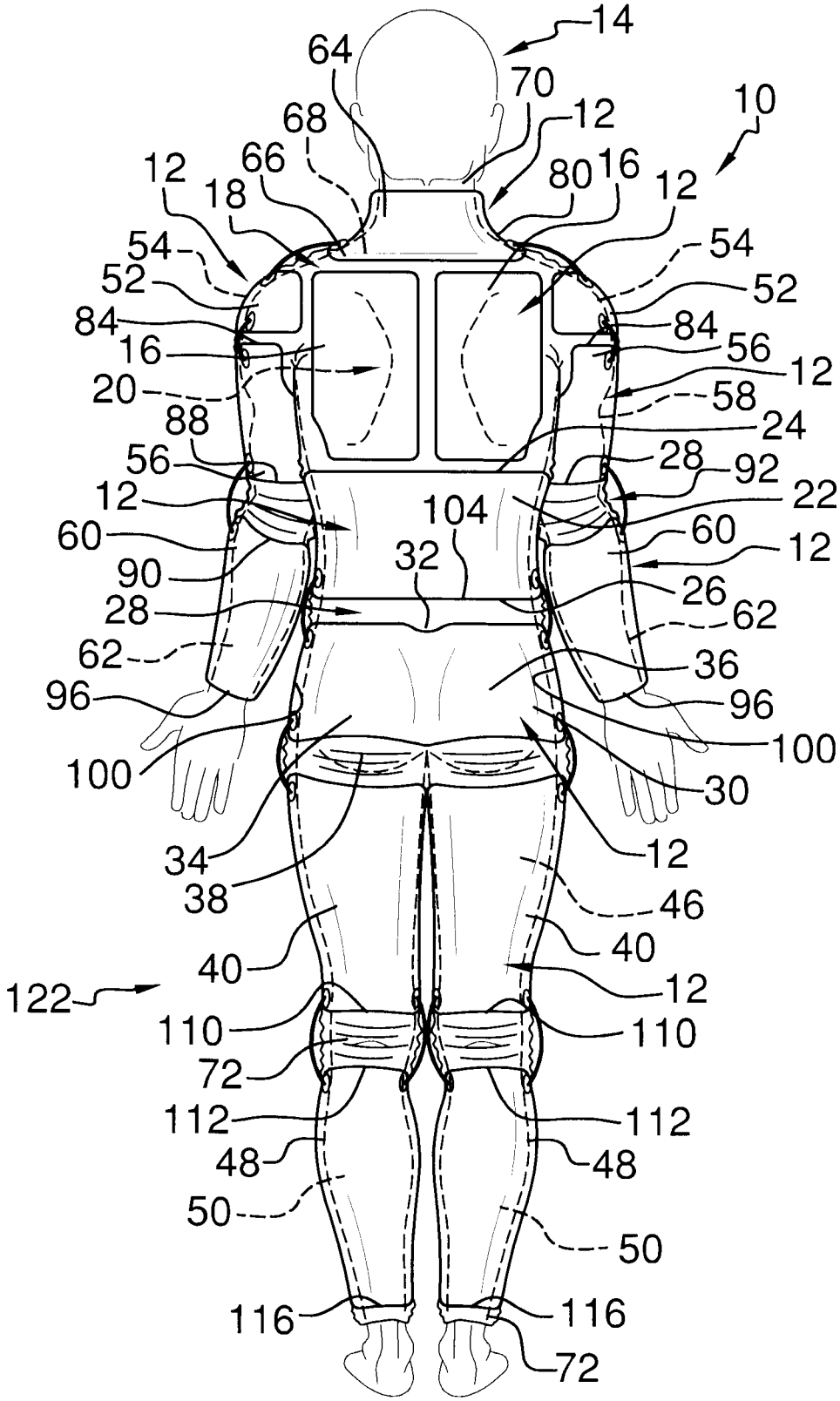
FIG. 1 is a back view of a personal armor assembly according to an embodiment of the disclosure.
Figure 2:
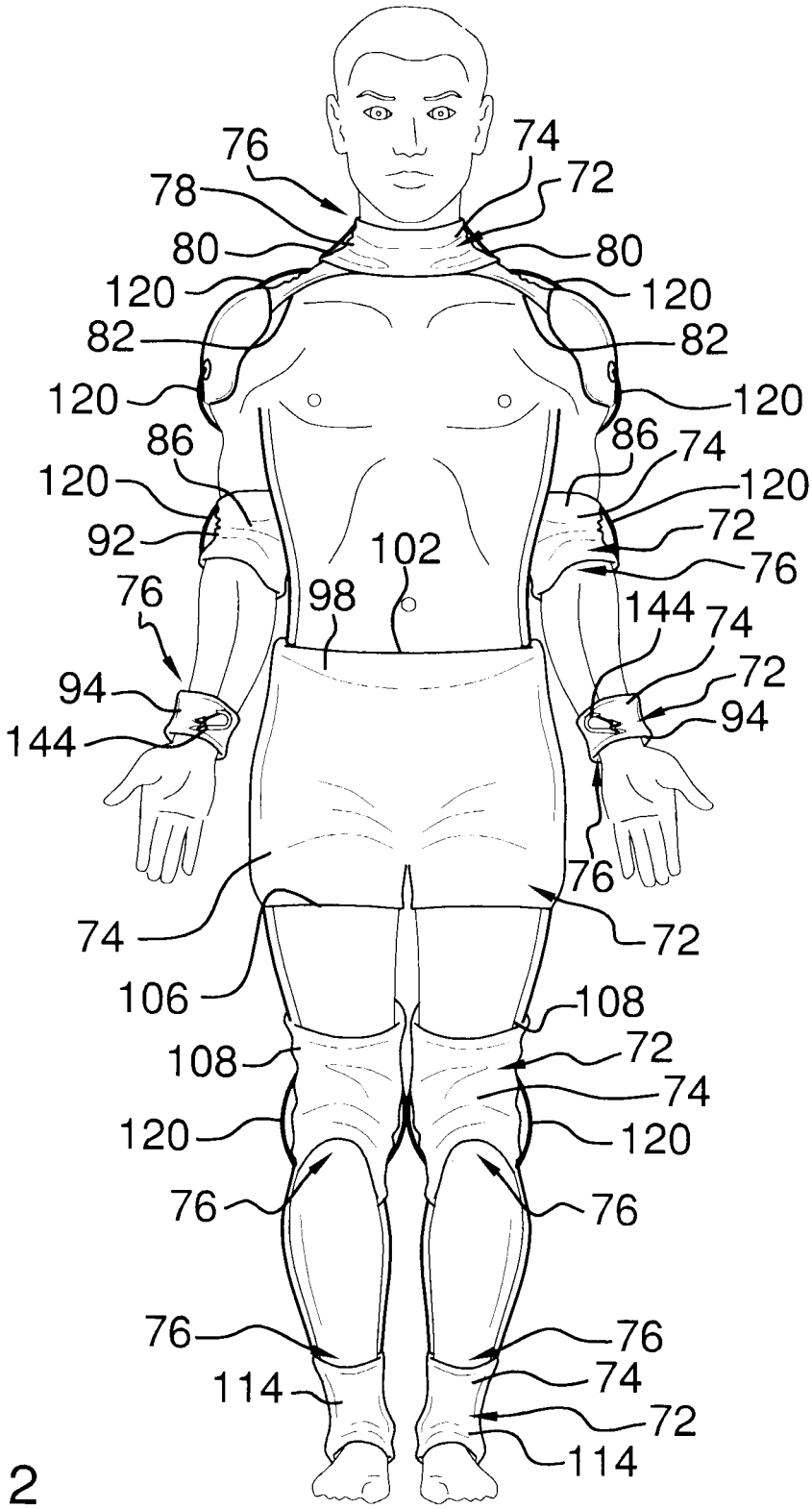
FIG. 2 is a front view of an embodiment of the disclosure in use.
Figure 3:
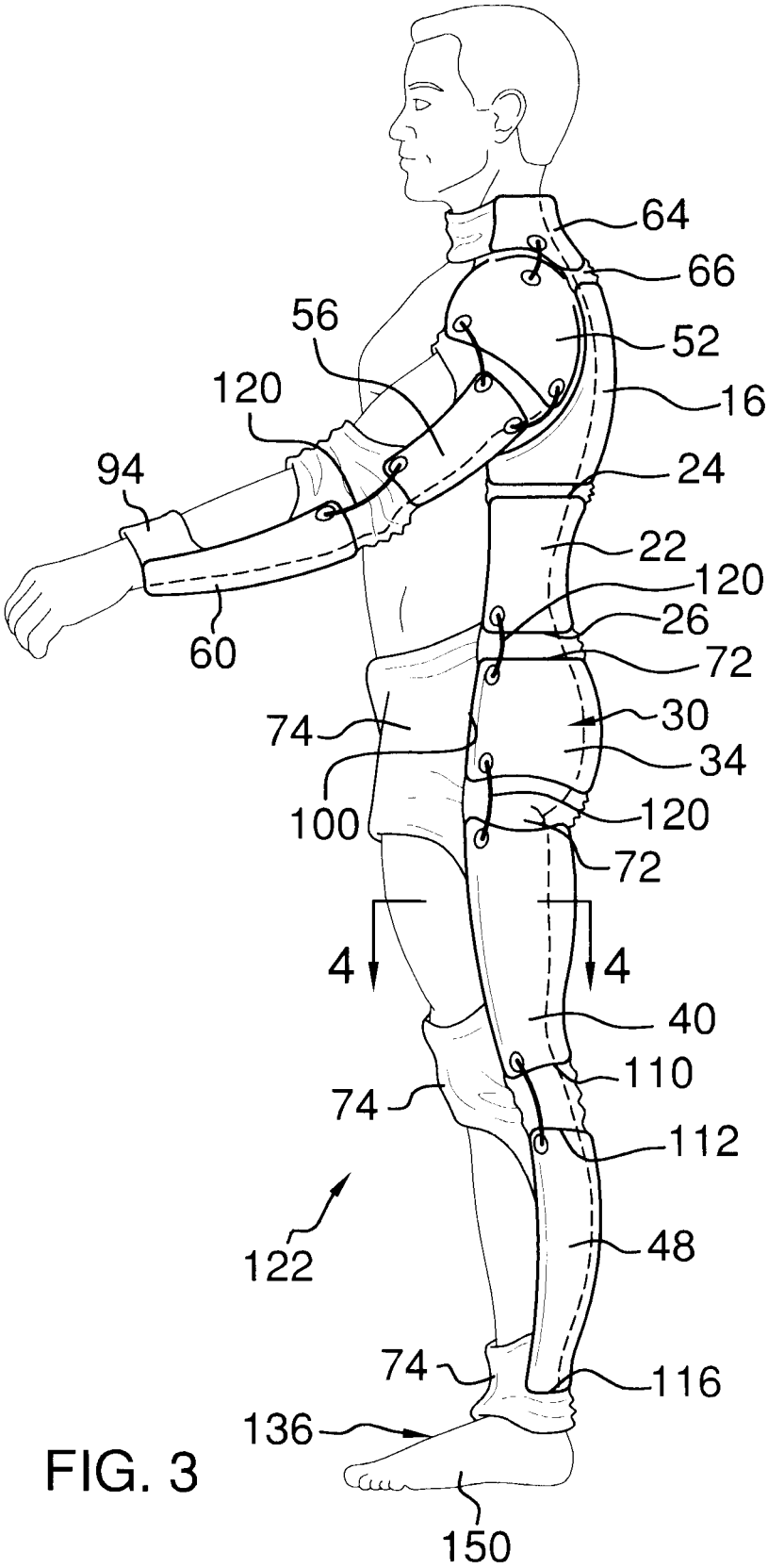
FIG. 3 is a side view of an embodiment of the disclosure.
Figure 4:
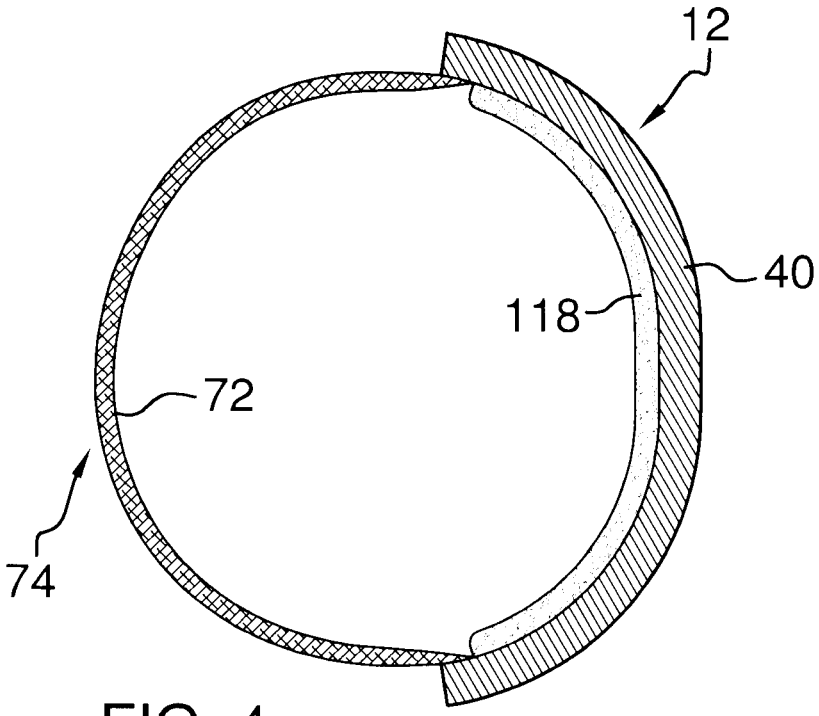
FIG. 4 is a cross-sectional view of an embodiment of the disclosure taken along line 4-4 of FIG. 3.
Figure 5:
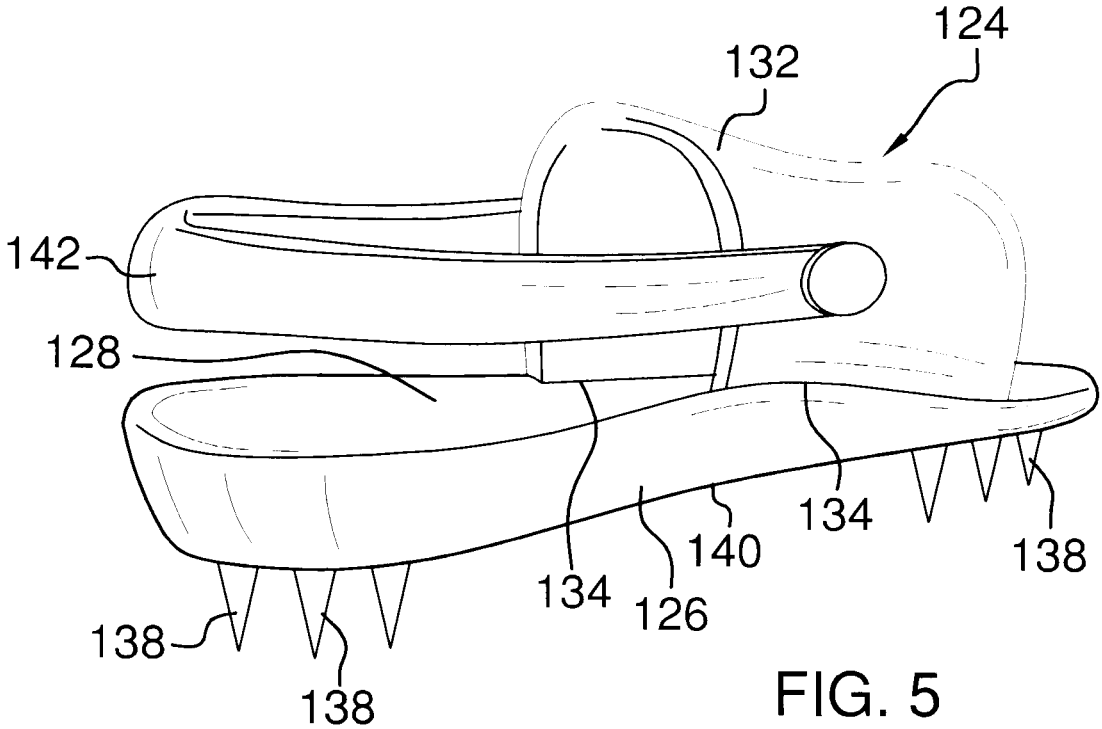
FIG. 5 is a top back side perspective view of foot armor of an embodiment of the disclosure.
Figure 6:
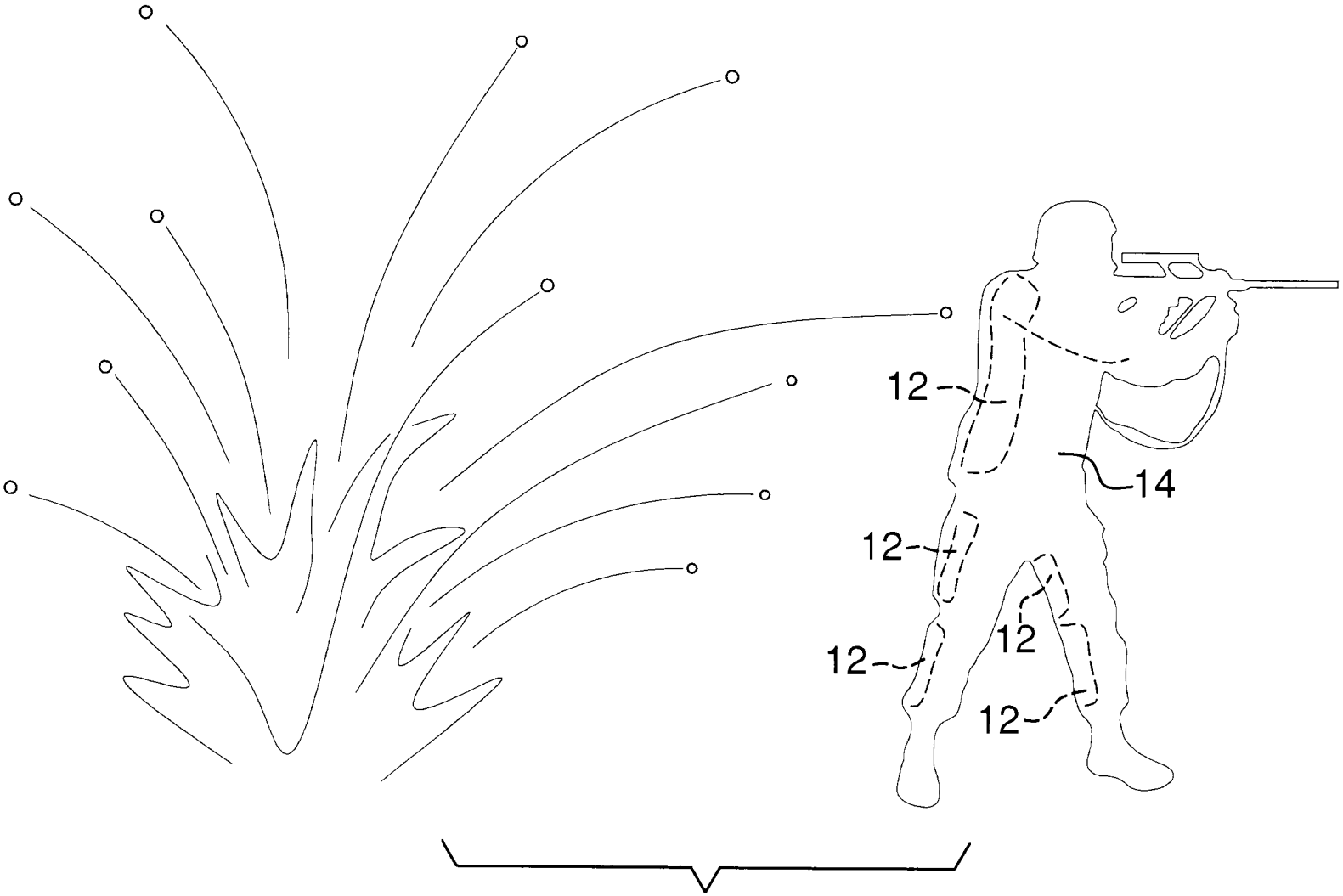
FIG. 6 is a front side view of an embodiment of the disclosure in use.

With reference now to the drawings, and in particular to FIGS. 1 through 6 thereof, a new personal armor device embodying the principles and concepts of an embodiment of the disclosure and generally designated by the reference numeral 10 will be described.

As best illustrated in FIGS. 1 through 6, the personal armor assembly 10 generally comprises a plurality of armor plates 12. Each armor plate 12 is curved wherein each armor plate 12 is configured to cover an associated dorsal section of a person 14. The armor plates 12 may include a pair of upper torso plates 16 configured to cover respective sides of a dorsal upper torso 18 of the person 14 substantially covering and protecting shoulder blades 20. The armor plates 12 may include a single lower back plate 22 having a generally C-shaped horizontal cross-sectional shape with upper and lower flared edges 24,26 configured to cover and support a lower back 28 of the person 14. The armor plates 12 may include a gluteal plate 30 having an upper notch 32 positioned between laterally positioned arched sections 34,36 configured to extend across and cover buttocks 38 of the person 14. The armor plates 12 may include a pair of thigh plates 40 with each being curved and tapering from an upper edge 42 to a lower edge 44. Thus, each thigh plate 40 is configured to cover respective thighs 46 of the person 14. The armor plates 12 may include a pair of calf plates 48 are similarly configured relative to the thigh plates 40 to cover respective calves 50 of the person 14. The armor plates 12 may also include a pair of shoulder plates 52. Each shoulder plate 52 is concave wherein each shoulder plate 52 is configured to cover respective shoulders 54 of the person 14. The armor plates 12 may include pair of upper arm plates 56 each curved about a longitudinal axis and tapered wherein the upper arm plates 56 are configured to cover respective upper arms 58 of the person 14. Similarly, the armor plates 12 may include a pair of forearm plates 60 are shaped such that the forearm plates 60 are configured to cover respective forearms 62 of the person 14. The armor plates 12 may include a neck plate 64 having a flared lower section 66 extending outwardly towards the shoulder plates 52 wherein the neck plate 64 is configured to cover and extend across base 68 of a neck 70 of the person 14. Padding 118 may line an inwardly facing side 120 of each armor plate 12 as exemplified in FIG. 4. While shown as it applies to the thigh plates 40, the padding 118 may similarly be applied to each armor plate 12.

A body member 72 is configured for being worn by the person 14. Each armor plate 12 is coupled to the body member 72 wherein the body member 72 extends between the armor plates 12 such that the armor plates 12 and body member 72 combined cover the dorsal side of the person 14 from neck to ankles and wrists. The body member 72 is constructed of a flexible protective material such as aramid fiber body protective fabric. The body member 72 has a plurality of forwardly extending portions 74 coupled to and extending from the armor plates 12 forming a plurality of loops 76 wherein the body member 72 is configured to extend around a body of the person 14. The armor plates 12 are supported against the dorsal side of the person 14.

The forwardly extending portions 74 of the body member 72 may include any of the following. A neck section 78 positioned to extend from opposite ends 80 of the neck plate 64 across the neck 70 of the person 14. A pair of shoulder sections 82 each extend from an upper end 84 of an associated one of the upper arm plates 56 and an associated one of the shoulder plates 52 across a ventral side of the upper arm 58 of the person 14. A pair of elbow sections 86 each extend from a lower end 88 of an associated one of the upper arm plates 56 and an upper end 90 of an associated one of the forearm plates 60 across a ventral side of an elbow joint 92 of the person 14. A pair of wrist sections 94 each extend from a lower end 96 of an associated one of the forearm plates 60 across a ventral side of the forearm 62 of the person 14. Hooks 144 may be coupled to the wrist sections 94 and used to facilitate climbing, grappling, carrying items or the like. A pelvic section 98 extends from opposite ends 100 of the gluteal plate 30. The pelvic section 98 has an upper edge 102 extending from a lower end 104 of the lower back plate 22 and a lower edge 106 extending from an upper end 118 of an associated one of the thigh plates 40. A pair of knee sections 108 each extend from a lower end 110 of an associated one of the thigh plates 40 and an upper end 112 of an associated one of the calf plates 48. A pair of ankle sections 114 each extend from a lower end 116 of an associated one of the calf plates 48.

A plurality of biasing members 120 are provided. Each biasing member 120 is coupled to and extends between adjacently positioned armor plates 12. The biasing members 120 may be elongated members urging the armor plates 12 into an upright position 122 wherein the armor plates 12 provide support to the person 14 relieving joint stress while providing protection to the person 14.

At least one foot member 124 may be provided. The foot member 124 comprises a substantially planar sole plate 126 having a curved upper surface 128 wherein the upper surface 128 of the foot member 124 is configured to support a foot 130 of the person 14. The foot member 124 further includes a band 132 having opposite ends 134 coupled to the sole plate 126 wherein the band 132 is configured to extend over an instep 136 of the foot 130 of the person 14 retaining the sole plate 126 on the foot 130. A plurality of spikes 138 may be coupled to and extend downwardly from a lower surface 140 of the sole plate 126. A heel strap 142 may be coupled to the band 132 to inhibit the foot member 124 from slipping off of the foot 130.

In use, the body member 72 and armor plates 12 are worn by the person 14. The armor plates 12 and body member 72 cover the dorsal side of the person 14. Thus, the person 14 is protected from dangers such as shrapnel or ordinance coming at the person 14 from the rear. The biasing members 120 assist in reducing stress and fatigue while also providing support to the person 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A personal armor assembly comprising:

a plurality of armor plates, each armor plate being curved wherein each said armor plate is configured to cover an associated dorsal section of the person;

a body member configured for being worn by a person, each armor plate being coupled to said body member wherein said body member extends between said armor plates, said body member having a plurality of forwardly extending portions forming a plurality of loops wherein said body member is configured to extend around a body of the person wherein said armor plates are supported against the dorsal side of the person; and a plurality of biasing members, each biasing member being coupled to and extending between adjacently positioned said armor plates, said biasing members urging said armor plates into an upright position wherein said armor plates provide support to the person.

2. The assembly of claim 1, further comprising said armor plates including a pair of upper torso plates configured to cover respective sides of a dorsal upper torso of the person, a lower back plate configured to cover a dorsal lower back of the person, a gluteal plate configured to extend across and cover buttocks of the person, a pair of thigh plates configured to cover respective thighs of the person, a pair of calf plates configured to cover respective calves of the person, a pair of shoulder plates configured to cover respective shoulders of the person, a pair of upper arm plates configured to cover respective upper arms of the person, a pair of forearm plates configured to cover respective forearms of the person, and a neck plate configured to cover and extend across a neck of the person.

3. The assembly of claim 2, further comprising said forwardly extending portions of said body member including a neck section positioned to extend from opposite ends of said neck plate across the neck of the person.

4. The assembly of claim 2, further comprising said forwardly extending portions of said body member including a pair of shoulder sections, each shoulder section extending from an upper end of an associated one of said upper arm plates and an associated one of said shoulder plates across a ventral side of the upper arm of the person.

5. The assembly of claim 2, further comprising said forwardly extending portions of said body member including a pair of elbow sections, each elbow section extending from a lower end of an associated one of said upper arm plates and an upper end of an associated one of said forearm plates across a ventral side of an elbow joint of the person.

6. The assembly of claim 2, further comprising said forwardly extending portions of said body member including a pair of wrist sections, each wrist section extending from a lower end of an associated one of said forearm plates across a ventral side of the forearm of the person.

7. The assembly of claim 2, further comprising said forwardly extending portions of said body member including a pelvic section extending from opposite ends of said gluteal plate.

8. The assembly of claim 7, further comprising said pelvic section having an upper edge extending from a lower end of said lower back plate.

9. The assembly of claim 7, further comprising said pelvic section having a lower edge extending from an upper end of an associated one of said thigh plates.

10. The assembly of claim 2, further comprising said forwardly extending portions including a pair of knee sections, each knee section extending from a lower end of an associated one of said thigh plates and an upper end of an associated one of said calf plates.

11. The assembly of claim 2, further comprising said forwardly extending portions including a pair of ankle sections, each ankle section extending from a lower end of an associated one of said calf plates.

12. The assembly of claim 1, further comprising said body member being constructed of a flexible protective material.

13. The assembly of claim 1, further comprising padding lining an inwardly facing side of each said armor plate.

14. The assembly of claim 1, further comprising a foot member, said foot member comprising a substantially planar sole plate having a curved upper surface wherein said upper surface of said foot member is configured to support a foot of the person, said foot member further comprising a band having opposite ends coupled to said sole wherein said band is configured to extend over an instep of a foot of the person retaining said sole plate on the foot.

15. The assembly of claim 14, further comprising a plurality of spikes coupled to and extending downwardly from a lower surface of said sole plate.

16. A personal armor assembly comprising:

a plurality of armor plates, each armor plate being curved wherein each said armor plate is configured to cover an associated dorsal section of the person, said armor plates comprising a pair of upper torso plates configured to cover respective sides of a dorsal upper torso of the person, a lower back plate configured to cover a dorsal lower back of the person, a gluteal plate configured to extend across and cover buttocks of the person, a pair of thigh plates configured to cover respective thighs of the person, a pair of calf plates configured to cover respective calves of the person, a pair of shoulder plates configured to cover respective shoulders of the person, a pair of upper arm plates configured to cover respective upper arms of the person, a pair of forearm plates configured to cover respective forearms of the person, and a neck plate configured to cover and extend across a neck of the person;

a body member configured for being worn by a person, each armor plate being coupled to said body member wherein said body member extends between said armor plates, said body member being constructed of a flexible protective material, said body member having a plurality of forwardly extending portions forming a plurality of loops wherein said body member is configured to extend around a body of the person wherein said armor plates are supported against the dorsal side of the person, said forwardly extending portions of said body member comprising a plurality of biasing members, each biasing member being coupled to and extending between adjacently positioned said armor plates, said biasing members urging said armor plates into an upright position wherein said armor plates provide support to the person, a neck section positioned to extend from opposite ends of said neck plate across the neck of the person, a pair of shoulder sections, each shoulder section extending from an upper end of an associated one of said upper arm plates and an associated one of said shoulder plates across a ventral side of the upper arm of the person, a pair of elbow sections, each elbow section extending from a lower end of an associated one of said upper arm plates and an upper end of an associated one of said forearm plates across a ventral side of an elbow joint of the person, a pair of wrist sections, each wrist section extending from a lower end of an associated one of said forearm plates across a ventral side of the forearm of the person, a pelvic section extending from opposite ends of said gluteal plate, said pelvic section having an upper edge extending from a lower end of said lower back plate, said pelvic section having a lower edge extending from an upper end of an associated one of said thigh plates, a pair of knee sections, each knee section extending from a lower end of an associated one of said thigh plates and an upper end of an associated one of said calf plates, and a pair of ankle sections, each ankle section extending from a lower end of an associated one of said calf plates;

padding lining an inwardly facing side of each said armor plate;

at least one foot member, said foot member comprising a substantially planar sole plate having a curved upper surface wherein said upper surface of said foot member is configured to support a foot of the person, said foot member further comprising a band having opposite ends coupled to said sole wherein said band is configured to extend over an instep of a foot of the person retaining said sole plate on the foot; and a plurality of spikes coupled to and extending downwardly from a lower surface of said sole plate.

* * * * *